US006581886B1

(12) United States Patent
Suh

(10) Patent No.: US 6,581,886 B1
(45) Date of Patent: Jun. 24, 2003

(54) ADJUSTABLE BABY BOTTLE HOLDER FOR A HAND CRIB

(75) Inventor: Simon Suh, Fullerton, CA (US)

(73) Assignee: E-Z Baby Products LLC, Hacienda Heights, CA (US)

( * ) Notice: Subject to any disclaimer, the term of this patent is extended or adjusted under 35 U.S.C. 154(b) by 0 days.

(21) Appl. No.: 09/847,497

(22) Filed: May 2, 2001

(51) Int. Cl.[7] ..... A47D 15/00

(52) U.S. Cl. ..... 248/104; 248/102; 248/103; 248/105; 248/106; 248/107

(58) Field of Search ..... 248/102, 104, 248/103, 105, 106, 229.14, 220.22, 214, 231.61

(56) References Cited

U.S. PATENT DOCUMENTS

| | | | | | |
|---|---|---|---|---|---|
| 1,688,765 | A | * | 10/1928 | Veras | 248/103 |
| 1,753,875 | A | * | 4/1930 | Baumann | 248/103 |
| 1,786,459 | A | * | 12/1930 | Simons | 248/104 |
| 4,114,847 | A | * | 9/1978 | Bogensberger | 248/104 |
| 5,032,015 | A | * | 7/1991 | Christianson | 138/118 |
| 5,083,732 | A | * | 1/1992 | Akamine | 248/104 |
| 5,135,189 | A | | 8/1992 | Ghazizadeh | 248/104 |
| 5,192,041 | A | | 3/1993 | Bryant | 248/104 |
| 5,489,075 | A | | 2/1996 | Ible | 248/104 |
| 5,664,746 | A | | 9/1997 | Benzakarya | 248/106 |
| 5,704,505 | A | * | 1/1998 | Singh | 215/11.1 |
| 5,823,486 | A | * | 10/1998 | Smith et al. | 248/103 |
| 5,873,551 | A | | 2/1999 | Jones | 248/102 |
| 6,003,821 | A | | 12/1999 | Fabian et al. | 248/104 |
| 6,250,592 | B1 | * | 6/2001 | Davis | 248/102 |

FOREIGN PATENT DOCUMENTS

| | | |
|---|---|---|
| FR | 343855 | * 10/1904 |

* cited by examiner

*Primary Examiner*—Leslie A. Braun
*Assistant Examiner*—Deborah M. Brann
(74) *Attorney, Agent, or Firm*—Fulbright & Jaworski L.L.P.

(57) ABSTRACT

An adjustable baby bottle holder for hand crib includes a clipping member. A flexible attaching member accepts the clipping member. The flexible attaching member has a partially open base, a centerline, a first extension and a second extension. The partially open base forms an interior channel that accepts the handle of a hand crib. The teeth on the first extension form valleys between each tooth that are separated from the centerline by a distance 'd1', which gradually decreases.

8 Claims, 4 Drawing Sheets

ADJUSTABLE BABY BOTTLE HOLDER FOR A HAND CRIB

BACKGROUND

The present invention relates to an adjustable baby bottle holder for use on a hand crib. The adjustable holder for a hand crib is used for holding a toy, baby bottle or other object in close proximity to the baby. The adjustable holder provides hands free feeding or entertainment of an infant. More particularly, the present invention pertains to devices that are attached to hand cribs that allow the toy or baby bottle to remain in or near the baby's hands or mouth without the continuous assistance of an attendant. Hand carried cribs require the use of at least one of the hands of the person carrying the crib. It is very difficult and awkward to hold a baby bottle, while also carry the hand crib. There is a need for an adjustable baby bottle holder that will easily attach to a hand crib and accommodate different sized hand crib handles with just one attachment mechanism.

Most of the prior art baby bottle holder devices are restricted in some direction of their movement and many are not designed to be attached to a hand crib. Unfortunately, the prior art devices typically are designed to be positioned by an adult, but they are not flexible enough with minimal friction to move with the child's mouth or hands.

Flexible arms are often used to position the bottle near the child. The flexible arms must be rigid enough to hold the weight of the bottle or toy, as such they are often too rigid to allow a young baby to move the bottle or toy by themselves just by the strength of their own head or hand movement.

The prior art devices show that there is a need for an adjustable baby bottle holder that will hold varying objects in close proximity to a child. Additionally, when the object is a baby bottle the holder needs to be movable in conformance with the head movements of the baby.

SUMMARY

An objective of the present invention, an adjustable baby bottle holder for a hand crib, is creating a device that will hold varying objects in close proximity to a child. A second objective of the adjustable baby bottle holder is easy attachment to a hand crib and accommodating different sized hand crib handles with just one attachment mechanism.

An additional objective of the adjustable baby bottle holder for hand crib is the holding of an adjustable baby bottle holder, which provides multiple directions of low resistance movement. The movement by the baby bottle holder in multiple spatial directions allows the bottle to remain in the baby's mouth despite head movement by the baby. Directions of head movement side-to-side and up or down.

An adjustable baby bottle holder for hand crib includes a clipping member having a central body, a first tip and a second tip. A flexible attaching member accepts the clipping member. The flexible attaching member has a partially open base, a centerline, a first extension and a second extension. The partially open base forms an interior channel that accepts the handle of a hand crib. The first extension has teeth, a first end and a first base end. The second extension also has teeth, a second end and a second base end. A connecting member is connected to the attaching member.

The teeth on the first extension form valleys between each tooth. The valleys of the first extension and the centerline are separated by a distance 'd1' that gradually decreases from the first base end to the first end. The first tip is accepted by the valleys on the first extension. The second extension forms valleys between each tooth. The valleys of the second extension and the centerline are separated by a distance 'd2', with 'd2' gradually decreasing from the second base end to the second end. The second tip is accepted by the valleys on the second extension.

The first extension has a first inside edge and the second extension has a second inside edge. The first inside edge and the second inside edge form an angle '$\alpha$' that is greater than 20 degrees prior to accepting the clipping member. The interior channel is substantially cylindrical between the first base end and the second base end. The flexible moving arm is attached to the connecting member and a gripping member is attached to the flexible moving arm. The connecting member has a ball joint that accepts the flexible moving arm.

Alternately a rotating arm can be included that is attached to the connecting member. The connecting member has a mound that rotatably accepts the rotating arm. Then She flexible moving arm is attached to the rotating arm and the gripping member is attached to the flexible moving arm. The rotating arm has a ball joint that accepts the flexible moving arm. The interior channel has a rubber pad that minimizes scratching or marring of the crib handle.

The gripping member can be an adjustable baby bottle holder. The gripping member has a first grasping member that can hold a baby bottle and the flexible attaching member can be secured with the clipping member to the handle of the hand crib.

The gripping member, which is an adjustable baby bottle holder, attaches to the flexible moving arm at the joint end. A rotating member is attached to the joint end of the flexible arm member. A top bar is rotatably attached to the rotating member. A bottom bar is attached to the top bar. The bottom bar and the top bar are substantially cylindrical in shape. The bottom bar is attached to the top bar by a back bar and a front bar. A grasping member is rotatably attached to the bottom bar.

The gripping member includes one or more fingers that are part of the grasping member. The fingers are a semicircle shape about the same diameter as the bottle which the grasping member is designed to hold, such that the fingers of the grasping member clasp about the bottle. The first grasping member is removably attached to the bottom bar such that the grasping member may be interchanged with a second grasping member having fingers that are of differing diameter than the first grasping member. The varying sized fingers can grasp different size baby bottles. The grasping member has a force fit snap-on mechanism that attaches to the rotating member.

The gripping member can take various forms that allow the gripping member to accept objects other than baby bottles. The object can be a toy, baby bottle or any other object that nurtures, entertains or distracts the baby. When the gripping member holds a toy, the flexible moving arm can be moved to position the toy near the baby's hands. If the gripping member holds a baby bottle, the flexible moving arm can be moved to position the baby bottle closer to the baby's mouth.

The first grasping member is designed to hold a baby bottle. The flexible arm can be moved and positioned such that the baby bottle is near the mouth of the baby. The baby bottle can move with the baby and remain in the baby's mouth since the rotating member rotates about the top bar. With the adjustable arm member the bottle can easily be tilted upward to prevent leaking of fluid from the nipple. This advantage applies when the baby is taking a short break from feeding so the bottle is temporarily not in use. The feature is also advantageous when the baby falls asleep while feeding where the bottle will remain generally in its established position and not lay nipple pointed downward prone to leaking.

The following drawings and description of the drawings provide greater specificity and detail of the elements of the invention.

DESCRIPTION

Figure 1:
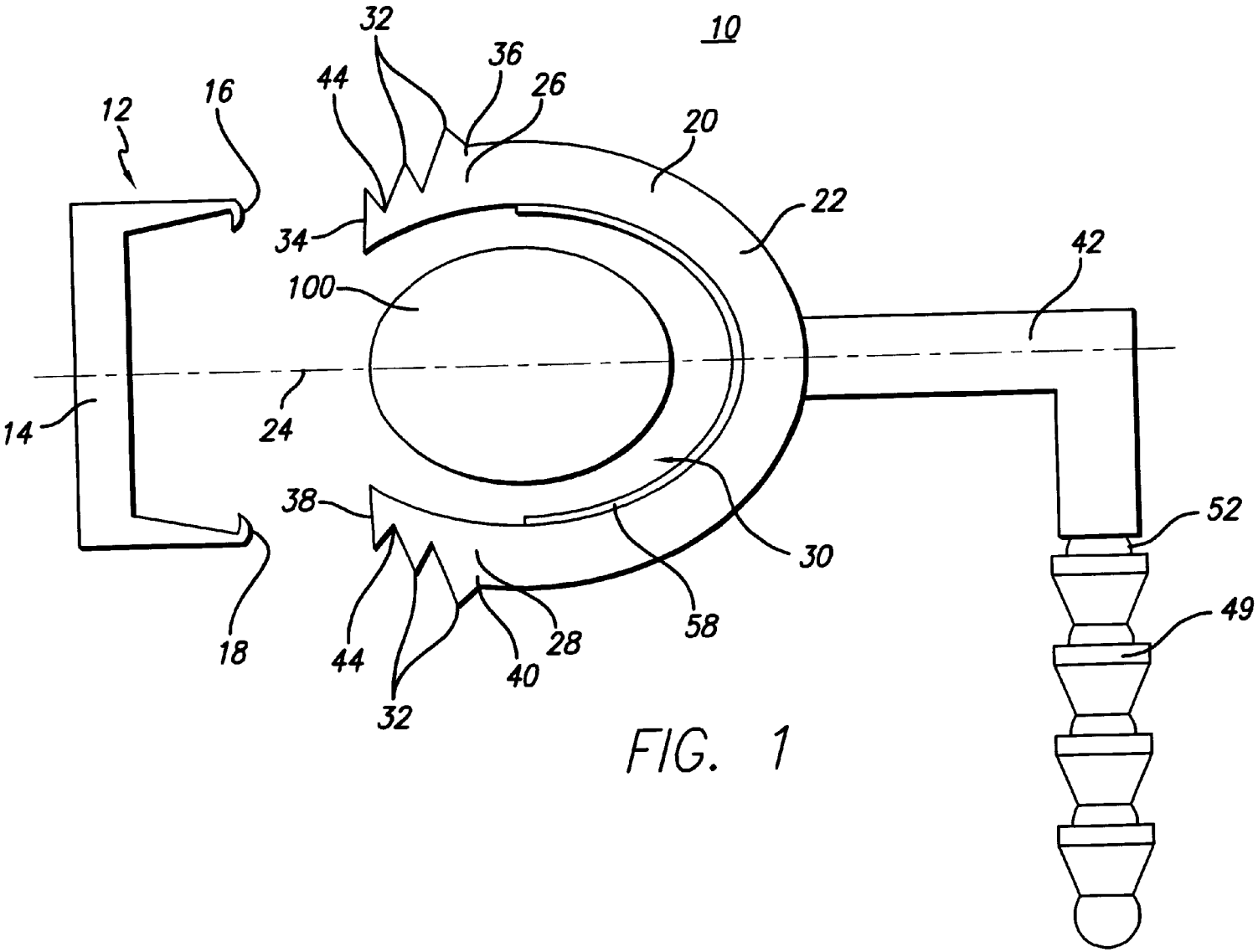
FIG. 1 is a side view of the invention
Figure 2:
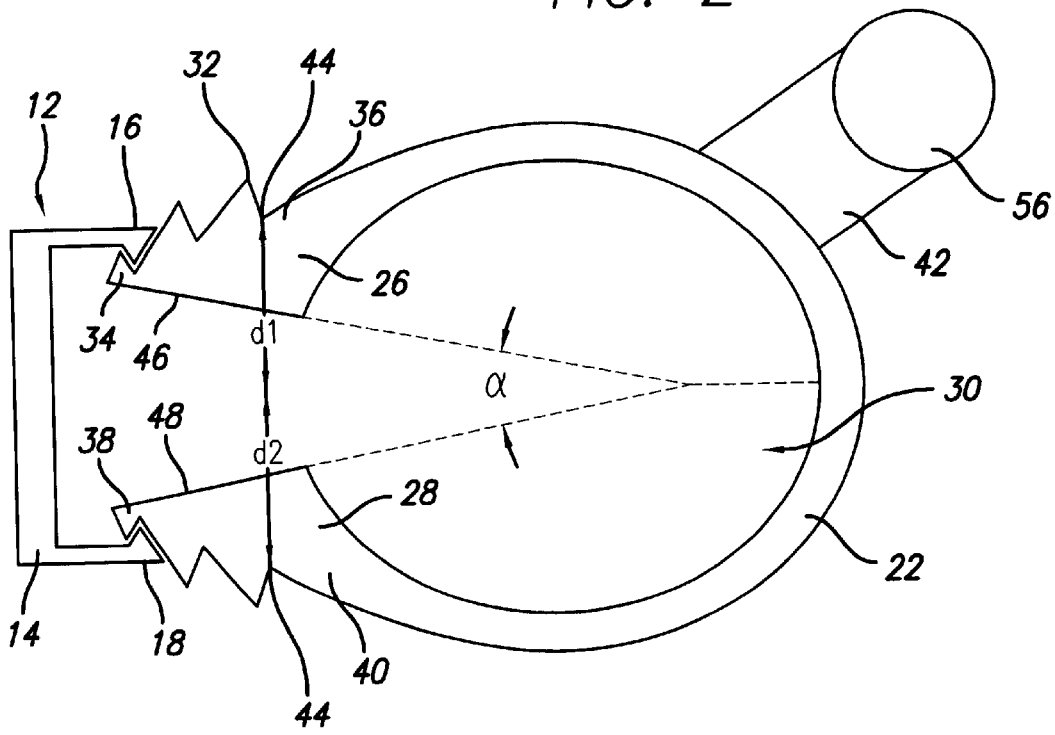
FIG. 2 is a close up side view of the flexible attaching member.

Referring to FIGS. 1 and 2, an adjustable baby bottle holder for hand crib 10 includes a clipping member 12 having a central body 14, a first tip 16 and a second tip 18. A flexible attaching member 20 accepts the clipping member 12. The flexible attaching member 20 has a partially open base 22, a centerline 24, a first extension 26 and a second extension 28. The partially open base 22 forms an interior channel 30 that accepts the handle 100 of a hand crib. The first extension has teeth 32, a first end 34 and a first base end 36. The second extension also has teeth 32, a second end 38 and a second base end 40. A connecting member 42 is connected to the attaching member 20.

The teeth 32 on the first extension 26 form valleys 44 between each tooth 32. The valleys 44 of the first extension 26 and the centerline 24 are separated by a distance 'd1' that gradually decreases from the first base end 36 to the first end 34. The first tip 16 is accepted by the valleys 44 on the first extension 26. The second extension 28 forms valleys 44 between each tooth 32. The valleys 44 of the second extension 28 and the centerline 24 are separated by a distance 'd2', with 'd2' gradually decreasing from the second base end 40 to the second end 38. The second tip 18 is accepted by the valleys 44 on the second extension 28.

To use the adjustable baby bottle holder for a hand crib 10, the interior channel 30 of the flexible attaching member 20 is placed around the handle 100 of the hand crib. Next the clipping member 12 is attached to the flexible attaching member 20 by inserting the first tip 16 and second tip 18 into the valleys 44 of the first extension 26 and second extension 28. The tightness of the flexible attaching member 20 upon the handle 100 can be varied, since the valleys 44 vary in height. Valleys 44 that have a greater distance 'd1' or 'd2' will create a greater tightening of the flexible attaching member 20 upon the handle 100. For larger diameter handles 100 the valleys 44 near the first end 34 and second end 38 can be used, which have a lesser distance 'd1' or 'd2'.

The invention can have varying height valleys 44 on both the first and second extension 26, 28. Alternately, just the first extension 26 can have varying height valleys 44 and the second extension 28 can be uniform in the level of the valleys 44 between the teeth 32. Attaching the clipping member 12 near the first base end 36 and second base end 40 creates a maximum tightening of the base 22. Attaching the clipping member 12 near the first end 34 and second end 38 creates a minimum tightening of the base 22. The clipping member 12 is an alligator-type clip.

Figure 3:
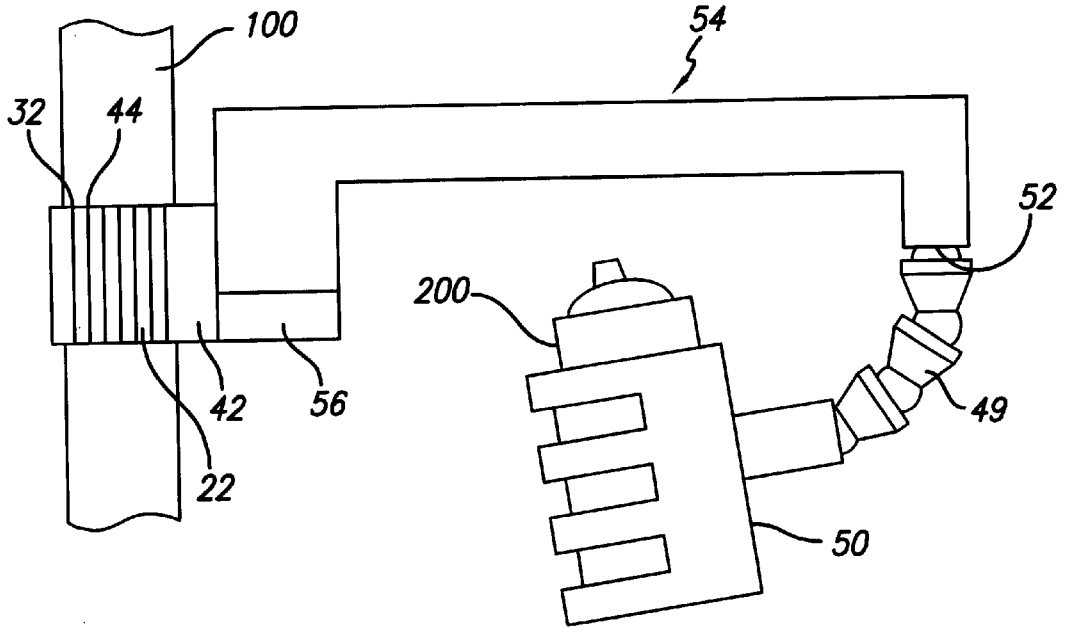
FIG. 3 is a top view of the invention including the rotating arm.

The flexible moving arm 49 is attached to the connecting member 42 and a gripping member 50, shown in FIG. 3, can be attached to the flexible moving arm 49. The connecting member 42 has a ball joint 52 that accepts the flexible-moving arm 49.

Referring particularly to FIG. 2, the first extension 26 has a first inside edge 46 and the second extension 28 has a second inside edge 48. The first inside edge 26 and the second inside edge 28 form an angle '$\alpha$' that is greater than twenty degrees prior to accepting the clipping member 12. The interior channel 30 is substantially cylindrical between the first base end 36 and the second base end 40. The interior channel 30 has a rubber pad 58 that minimizes scratching or marring of She crib handle 100. The pad 58 can be varied in thickness or multiple pads 58 can be used to modify the size of the interior channel 30, so that different sized crib handles 100 can be accommodated.

Referring to FIG. 3, a top view of the invention is shown. A rotating arm 54 can be included that is attached to the connecting member 42. The connecting member 42 has a mound 56 that rotatably accepts the rotating arm 54. The connecting member 42 is very short in this embodiment with the rotating member 54 providing the necessary length to position the gripping member 50 near an infant. Then the flexible moving arm 49 is attached to the rotating arm 54 and the gripping member 50 is attached to the flexible moving arm 49. The gripping member 50 grasps a baby bottle 200. The flexible moving arm 49 is bent sharply, illustrating the flexibility of positions for the baby bottle 200. The handle 100 of the hand crib protrudes from the base 22. The teeth 32 and the valleys 44 of the first extension 26 are visible in this top view.

The rotating arm 54 has a ball joint 52 that accepts the flexible moving arm 49. The rotating arm 54 can be loosely connected to the mound 56, so that the infant can move the rotating arm 54. Conversely, the rotating arm 54 can be tightly connected to the mound 56, so that the strength of an adult is needed to reposition the rotating arm 54.

Figure 4:
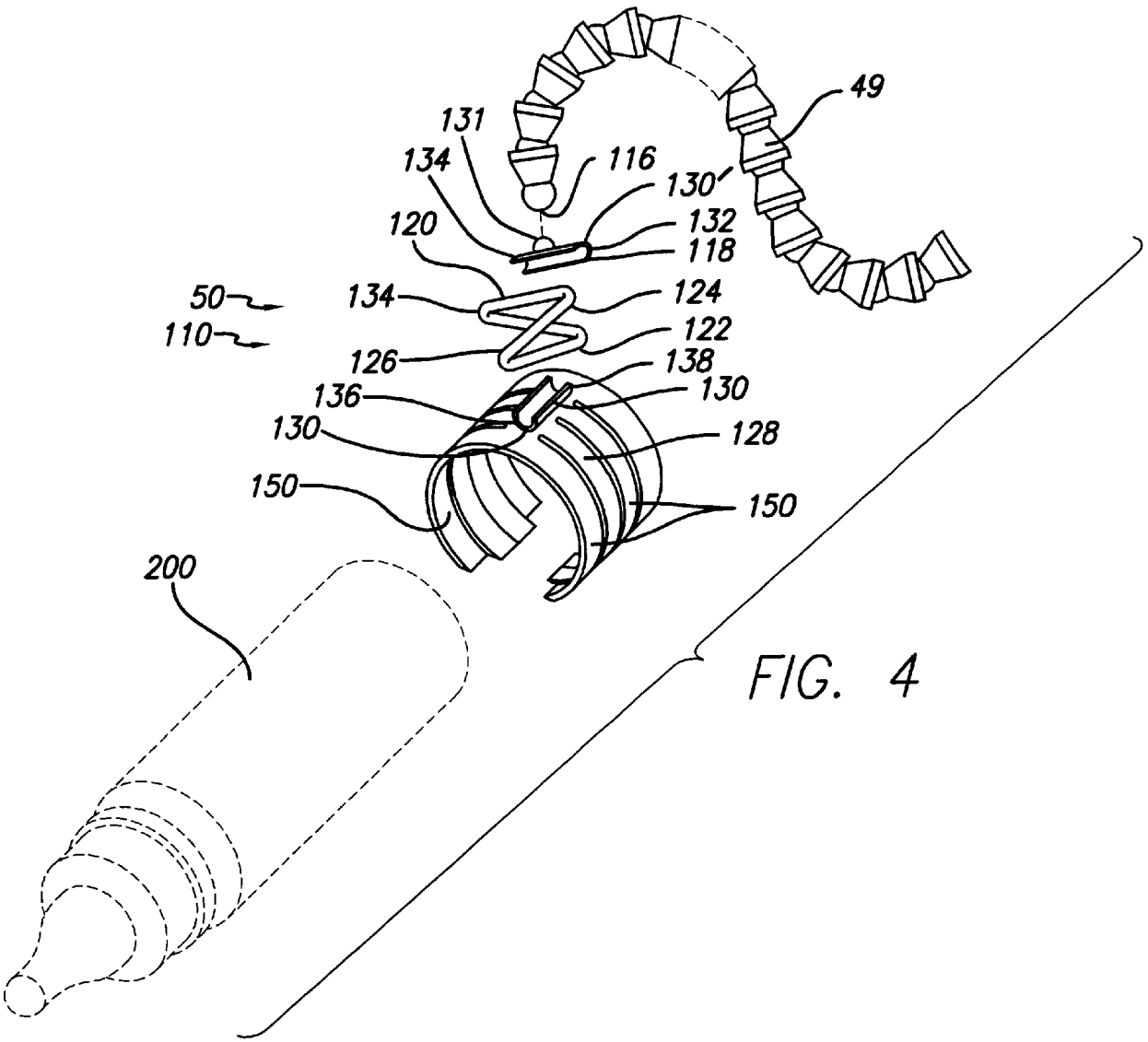
FIG. 4 is an exploded perspective view of the flexible moving arm and the gripping member as an adjustable baby bottle holder.
Figure 6:
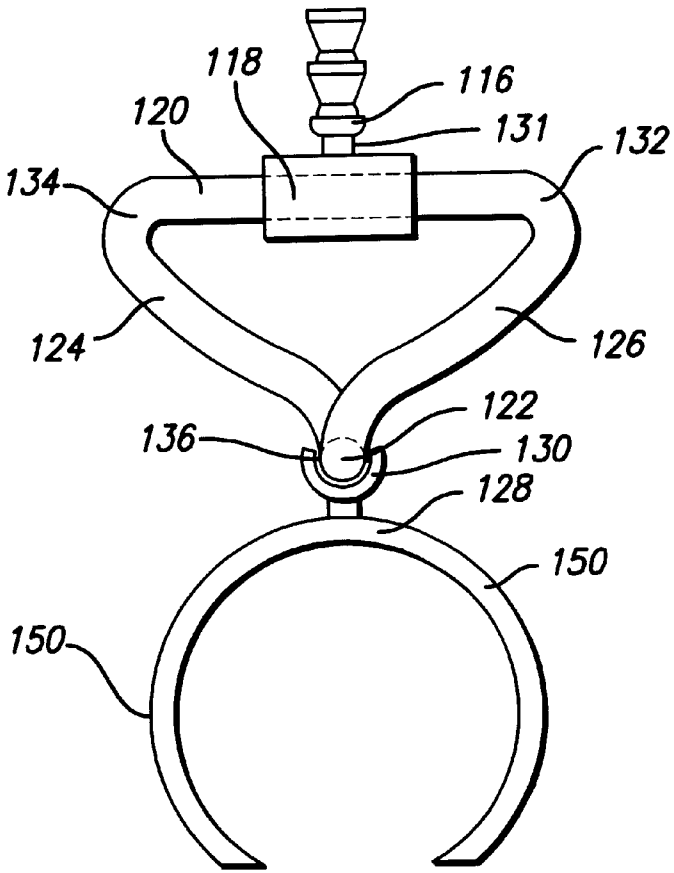
FIG. 6 is a front view of the grasping member and rotating member of the adjustable baby bottle holder.
Figure 5:
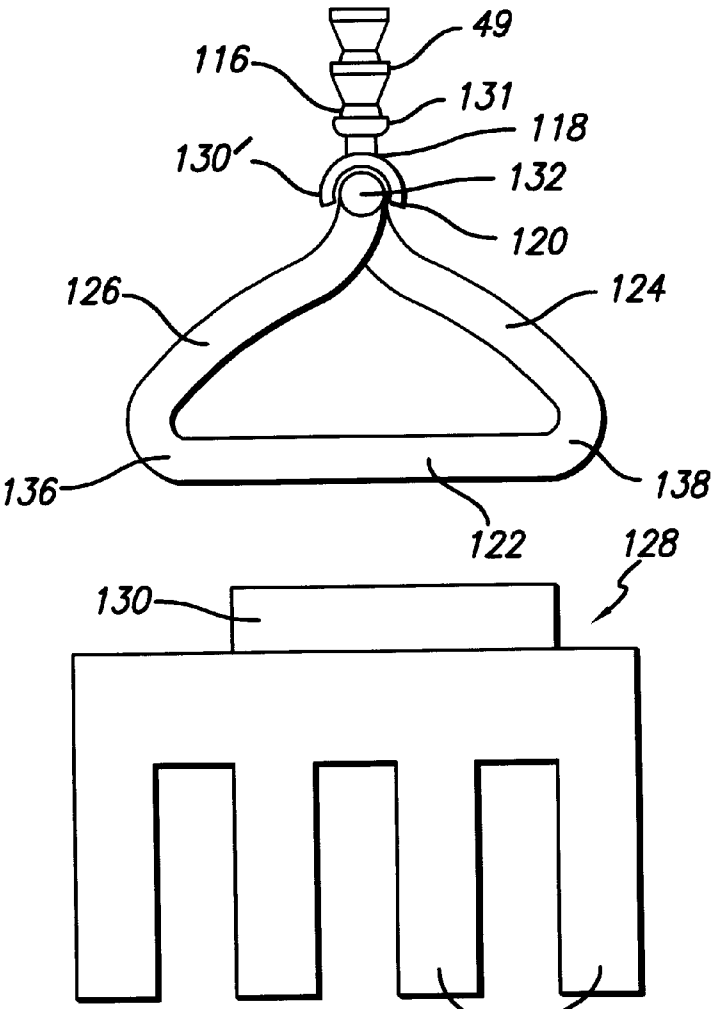
FIG. 5 is an exploded side view of the grasping member and rotating member of the adjustable baby bottle holder.

Referring to FIGS. 4, 5 and 6 that show an embodiment of the gripping member 50. FIG. 4 is an exploded perspective view of the gripping member 50 as an adjustable baby bottle holder 110. The adjustable baby bottle holder 110 attaches to the flexible moving arm 49 at the joint end 116. A rotating member 118 is attached to the flexible moving arm 49. A top bar 120 is rotatably attached to the rotating member 118. A bottom bar 122 is attached to the top bar 120. The bottom bar 122 and the top bar 120 are substantially cylindrical in shape. The bottom bar 122 is attached to the top bar 120 by a back bar 124 and a front bar 126. A grasping member 128 is rotatably attached to the bottom bar 122.

The grasping member 128 has a force fit snap-on mechanism 130 that allows the grasping member 128 to rotatably attach to the bottom bar 122. The flexible moving arm 49 is attached at the joint end 116 to the rotating member 118. A nodule 131 located on the rotating member 118 snaps into the joint end 116 of the flexible moving arm 49.

The top bar 120 and the bottom bar 122 are generally perpendicular to each other. The top bar 120 and bottom bar 122 are connected by the front bar 126 and the back bar 124.

The top bar 120 further has a first end 132 and a second end 134. The bottom bar 122 has a third end 136 and a fourth end 138. The front bar 126 attaches to the first end 132 and the third end 136. The back bar 124 attaches to the second end 134 and the fourth end 138. The front bar 126 and the back bar 124 can twist to form the generally perpendicular orientation of the top bar 120 and the bottom bar 122, such that there are two directions of freedom of rotation for the baby bottle 200. The front bar 126 and the back bar 124 can be symmetrical or may vary in shape from each other.

FIG. 5 is an exploded side view of the first embodiment of the invention. The flexible moving arm 49 attaches at the joint end 116 to the nodule 131 of the rotating member 118. The top bar 120 is rotatably attached within the rotating member 118. The rotating member 118 has a force fit snap-on mechanism 130'. The grasping member 128 also has a force fit snap-on mechanism 130 that attaches to the bottom bar 122. The top bar 120 and the bottom bar 122 are generally perpendicular to each other. The top bar 120 and bottom bar 122 are connected by the front bar 126 and the back bar 124. The front bar 126 attaches to the first end 132 of the top bar 120 and the third end 136 of bottom bar 122. The back bar 124 attaches to the second end 134 of the top bar 120 and the fourth end 138 of bottom bar 122. The second end 134 of the top bar 120 is hidden from view.

The front bar 126 and the back bar 124 are twisted. Two principle directions of movement are provided. First, the top bar 120 rotates circumferentially within the rotating member 118. Second, the force fit snap-on mechanism 130 on the grasping member 128 rotates circumferentially about the bottom bar 122 in a generally perpendicular orientation to the top bar 120.

FIG. 6 is a front view of the details shown in FIG. 5. The twisting and generally perpendicular orientation of the top bar 120 and bottom bar 122 are apparent from the two views. FIG. 6 is not an exploded view, thus FIG. 6 shows the force fit snap-on mechanism 130 of the grasping member 128 connected to the bottom bar 122. The first end 132 and second end 134 of the top bar 120 can be readily seen as they protrude from the rotating member 118. The third end 136 of the bottom bar 122 is shown, while the fourth end 138 is hidden from view. The grasping member 128 has fingers 150 that partially encircle and grasp a baby bottle 200. Other objects can be held with the grasping member 128, including a toy.

Although not shown, the gripping member 50 can be varied so that the rotating member 118 has a hooking bar. The top bar 120 has a through hole. The through hole receives the hooking bar. The front bar 126 and the back bar 124 connect the top bar 120 and the bottom bar 122. The grasping member 128 rotatably attaches to the bottom bar 122. The top bar 120 and the bottom bar 122 are generally perpendicular to each other. The flexible moving arm 49 attaches to the connecting member 42.

The invention is ideally suited for holding a baby bottle 200, since young infants cannot hold the baby bottle 200 with their own hands. The adjustable baby bottle holder for hand crib 10 allows the baby bottle 200 to be positioned near the mouth of the baby, remain near the baby's mouth and move rotatably in conformance with head movements of the baby. The adjustable baby bottle holder for hand crib 10 can be formed from plastic, aluminum, fiberglass or other flexible materials. The flexibility of the adjustable baby bottle holder for a hand crib 10 allows the invention to be at.ached to the handles 100 of varying dimension.

Although the present invention has been described in considerable detail with regard to the preferred versions thereof, other versions are possible. Therefore, the appended claims should not be limited to the descriptions of the preferred versions contained herein.

What is claimed is:

1. An adjustable baby bottle holder for hand crib comprising:

a) a clipping member having a central body, a first tip and a second tip;

b) a flexible attaching member that accepts the clipping member, wherein the flexible attaching member has a partially open base, a centerline, a first extension and a second extension, wherein the partially open base forms an interior channel that accepts the handle of a hand crib, wherein the first extension having teeth, a first end and a first base end, and wherein the second extension having teeth, a second end and a second base end; and c) a connecting member connected to the attaching member;

d) a rotating arm attached to the connecting member, e) a flexible moving arm attached to the rotating arm; and f) a gripping member attached to the flexible moving arm; wherein the teeth on the first extension forms valleys between each tooth, wherein the valleys of the first extension and the centerline are separated by a distance 'd1', wherein 'd1' gradually decreases from the first base end to the first end, wherein the first tip is accepted by the valleys on the first extension, wherein the second extension forms valleys between each tooth, wherein the valleys of the second extension and the centerline are separated by a distance 'd2', wherein 'd2' gradually decreases from the second base end to the second end, wherein the second tip is accepted by the valleys on the second extension, wherein the first extension further having a first inside edge and the second extension further having a second inside edge, wherein the first inside edge and the second inside edge form an angle '$\alpha$', wherein '$\alpha$' is greater than 20 degrees prior to accepting the clipping member, wherein the interior channel is substantially cylindrical between the first base end and the second base end, wherein the connecting member further having a mound that rotatably accepts the rotating arm, wherein the rotating arm further having a ball joint that accepts the flexible moving arm, wherein the interior channel further having a rubber pad, wherein the gripping member further comprising:

a) a rotating member;

b) a top bar rotatably attached to the rotating member;

c) a bottom bar attached to the top bar; and d) a grasping member rotatably attached to the bottom bar; wherein the top bar and the bottom bar are generally perpendicular to each other.

2. The adjustable baby bottle holder for hand crib of claim 1 further having a front bar and a back bar, wherein the top bar further having a first end and a second end, wherein the bottom bar further having a third end and a fourth end, wherein the front bar attaches to the first end and the third end, wherein the back bar attaches to the second end and the fourth end.

3. The adjustable baby bottle holder for hand crib of claim 2 wherein the front bar and the back bar twist to form the generally perpendicular orientation of the top bar and the bottom bar, such that there are two directions of freedom of rotation for the baby bottle.

4. The adjustable baby bottle holder of claim 3 wherein the grasping member further having a force fit snap-on mechanism, wherein the grasping member is attached to the bottom bar by the force fit snap-on mechanism.

5. An adjustable baby bottle holder for hand crib comprising:

a) a clipping member having a central body, a first tip and a second tip;

b) a flexible attaching member that accepts the clipping member, wherein the flexible attaching member has a partially open base, a centerline, a first extension and a second extension, wherein the partially open base forms an interior channel that accepts the handle of a hand crib, wherein the first extension having teeth, a first end and a first base end, and wherein the second extension having teeth, a second end and a second base end; and c) a connecting member connected to the attaching member;

d) a flexible moving arm attached to the connecting member; and e) a gripping member attached to the flexible moving arm; wherein the teeth on the first extension forms valleys between each tooth, wherein the valleys of the first extension and the centerline are separated by a distance 'd1', wherein 'd1' gradually decreases from the first base end to the first end, wherein the first tip is accepted by the valleys on the first extension, wherein the second extension forms valleys between each tooth, wherein the valleys of the second extension and the centerline are separated by a distance 'd2', wherein 'd2' gradually decreases from the second base end to the second end, wherein the second tip is accepted by the valleys on the second extension, wherein the first extension further having a first inside edge and the second extension further having a second inside edge, wherein the first inside edge and the second inside edge form an angle '$\alpha$', wherein '$\alpha$' is greater than 20 degrees prior to accepting the clipping member, wherein the interior channel is substantially cylindrical between the first base end and the second base end, wherein the gripping member further comprising a) a rotating member;

b) a top bar rotatably attached to the rotating member;

c) a bottom bar attached to the top bar; and d) a grasping member rotatably attached to the bottom bar; wherein the top bar and the bottom bar are generally perpendicular to each other.

6. The adjustable baby bottle holder for hand crib of claim 5 further having a front bar and a back bar, wherein the top bar further having a first end and a second end, wherein the bottom bar further having a third end and a fourth end, wherein the front bar attaches to the first end and the third end, wherein the back bar attaches to the second end and the fourth end.

7. The adjustable baby bottle holder for hand crib of claim 6 wherein the front bar and the back bar twist to form the generally perpendicular orientation of the top bar and the bottom bar, such that there are two directions of freedom of rotation for the baby bottle.

8. The adjustable baby bottle holder for hand crib of claim 7 wherein the grasping member further having a force fit snap-on mechanism, wherein the grasping member is attached to the bottom bar by the force fit snap-on mechanism.

* * * * *